United States Patent [19]

Johnson, Jr.

[11] Patent Number: 5,048,840

[45] Date of Patent: Sep. 17, 1991

[54] GAMEBOARD BUILDING APPARATUS

[76] Inventor: Albert L. Johnson, Jr., 3913 Deborah La., Anchorage, Ak. 99504

[21] Appl. No.: 594,429

[22] Filed: Oct. 9, 1990

[51] Int. Cl.[5] ..... A63F 3/00; A63H 33/08

[52] U.S. Cl. ..... 273/241; 273/282; 273/283; 273/290; 446/118

[58] Field of Search ..... 273/241, 290, 283, 284, 273/282 R, 282 B, 282 C; 446/117, 118

[56] References Cited

U.S. PATENT DOCUMENTS

| | | | |
|---|---|---|---|
| 16,560 | 7/1904 | Taylor | 273/290 |
| D. 221,390 | 8/1971 | Skillman | 273/241 |
| 3,610,626 | 10/1971 | Nolte | 273/283 |
| 3,692,310 | 9/1972 | Martin | 273/241 |
| 4,776,597 | 10/1988 | Rudell | 273/272 |
| 4,903,969 | 2/1990 | Williams | 273/248 |

FOREIGN PATENT DOCUMENTS

| | | | |
|---|---|---|---|
| 224381 | 6/1987 | European Pat. Off. | 273/262 |
| 994883 | 11/1951 | France | 273/282 |

*Primary Examiner*—Benjamin Layno
*Attorney, Agent, or Firm*—Abe Hatcher

[57] ABSTRACT

A gameboard apparatus made up of a gameboard adapted to have assembled thereon stacking pieces and top pieces that are frictionally interlockable onto the gameboard and with each other. The gameboard comprises a plurality of adjacent gameboard or playing-position squares arranged in an equilateral matrix and is preferably divided into equal sections. The squares each comprise within their bounds vertical walls adapted to frictionally interlock with complementing vertical walls of stacking pieces and top pieces. The stacking pieces are hermaphroditic in nature having on one end interlocking male wall and on the other interlocking female walls whereby stacking pieces are adapted to frictionally interlock with complementing vertical walls of the gameboard, top pieces and each other. The top pieces comprise on an upper end a flat surface upon which to place game-playing articles and on the other end vertical walls adapted to frictionally interlock with complementing vertical walls of the gameboard and stacking pieces. The gameboard with the stacking pieces and top pieces built upon the gameboard may be placed in a tray and packaged as an assembly kit.

19 Claims, 3 Drawing Sheets

GAMEBOARD BUILDING APPARATUS

BACKGROUND OF THE INVENTION

1. Field of the Invention

This invention relates to gameboard apparatus. More particularly, it relates to gameboard apparatus and a tray containing same.

2. Description of the Prior Art

Lorenz U.S. Pat. No. 3,871,657 describes a multilevel threedimensional gameboard which enables game participants in conventional chess or checkers to design a topography of the board, specifically, by using loose magnetized pieces of different heights to serve as supporting seats for checkers or chessmen. Rudell U.S. Pat. No. 4,776,597 involves a gameboard having raised bosses on which are stacked identical playing pieces with differently lettered top surfaces, each having a peripheral skirt about its lower edge and an offset shoulder about its top edge for playing a word game. Eplett U.S. Pat. No. 4,696,476 has to do with a multistepped checkerboard divided into four magnetized sections, each of the four sections forming a permanent stepped playing surface arranged in seven levels or planes so as to make up rows of monotonic steps, with the possibility of making a variety of mountain, valley and mountain-valley configurations. Berger U.S. Pat. No. 3,406,975 discloses a two-dimensional chessboard made up of at least five separate sections. Stookey U.S. Design Pat. No. 210,542 shows a packaged multistepped gameboard. All of the foregoing patents are highly limited in number of designs, terrains and topographies and permit little variation in topographical opportunities in game playing.

SUMMARY OF THE INVENTION

After extended investigation I have devised gameboard apparatus which has several unique features and advantages over prior art gameboard apparatus intended to be used for a multilevel surface for playing checkers and chess, or the like.

For example, the board of this invention may be divided into a plurality of sections, all of which can be built upon with stacking pieces and top pieces according to the invention. The sections may then be placed together side by side to form a complete gameboard of one topography and subsequently rearranged or reoriented to quickly and easily result by each change in placement of sections in a different topography. The gameboard sections may easily be rebuilt upon by adding, reducing, redistributing or rearranging the stacking pieces and top pieces to form still different topographies. The process of rebuilding and rearranging may be repeated over and over and thus almost innumerable patterns, terrains, or topographies may be built to play games on.

According to my invention the gameboard may be frictionally interlocked with stacking pieces and top pieces mentioned hereinabove and will be defined hereinbelow.

According to a further embodiment of my invention the aforesaid stacking pieces and top pieces may be stacked or built on the gameboard of the invention with the gameboard placed in a tray for carrying, storing or packaging purposes. When the gameboard is made in separate square sections, the tray is of the same size as if a square one-piece gameboard is placed in the tray. The tray with assembled gameboard therein may be packaged in wrapping material, for example, plastic which may be part or all see-through. It may be heat or blister-sealed if desired.

The gameboard, or the sections of a gameboard or my invention put together to form a gameboard, are made up of a plurality of gameboard or playing-position squares such as the 64 of a checkers or chess board or the 81 of an oriental chess or "Shogi" board, although the gameboard squares need not be marked or checkered as such. A checkered appearance, if desired, may be provided by alternately colored top pieces.

Each gameboard or playing-position square of the gameboard, according to my invention, is made up of vertical wall adapted to frictionally engage the complementing walls of a superjacent stacking piece or top piece. When I refer to any walls hereinafter, it is understood that the walls must be substantially vertical according to the invention. The wall may be female or male. When female, the walls run around a peripheral edge or the perimeter of each gameboard squares so as to permit the horizontally indented male walls of a superjacent stacking piece or top piece to coactively and frictionally interlock therewith. When male, the walls are horizontally indented within the bounds of a gameboard square so as to permit the female walls of a superjacent stacking piece or top piece to frictionally interlock therewith.

Stacking pieces, when used, elevate and support a top piece at a desired height. The stacking pieces are basically building components having hermaphroditic characteristics, one portion functioning as a female connector and another as a male connector. One portion comprises female peripheral walls and an opposing portion comprises a horizontally indented male wall. When assembling or packaging the gameboard apparatus, the female peripheral wall of a stacking piece may frictionally interlock with a gameboard indented male wall, the indented male wall of another stacking piece or the indented male wall of a top piece. Likewise, the horizontally indented male walls of a stacking piece may frictionally interlock with the gameboard female walls, the peripheral female walls of a stacking piece, or the peripheral female walls of a top piece.

The top pieces are used to provide top flat square playing surfaces for placement thereon of checkers or chessmen or other type playing pieces. They are made up of a top level playing surface and opposing walls which may be male or female frictionally interlockable with a complementing female or male walls of a stacking piece or of the gameboard. As the female walls of the stacking pieces and the female walls of the gameboard, the female walls of the top pieces are peripheral and an outer surface of each follows the bounds of a gameboard square. As the male walls of the stacking pieces and the male walls of the gameboard, the male walls of the top pieces are horizontally equally indented from the bounds of a gameboard or playing-position square. The top pieces may be of two parts. When of two parts, a flat round or square part fits and frictionally interlocks on a complementing inner ledge of the opposing wall of the top pieces.

BRIEF DESCRIPTION OF THE DRAWING

For a better understanding of my invention reference will now be made to the drawing which forms a part hereof.

DETAILED DESCRIPTION OF THE INVENTION

Figure 1:
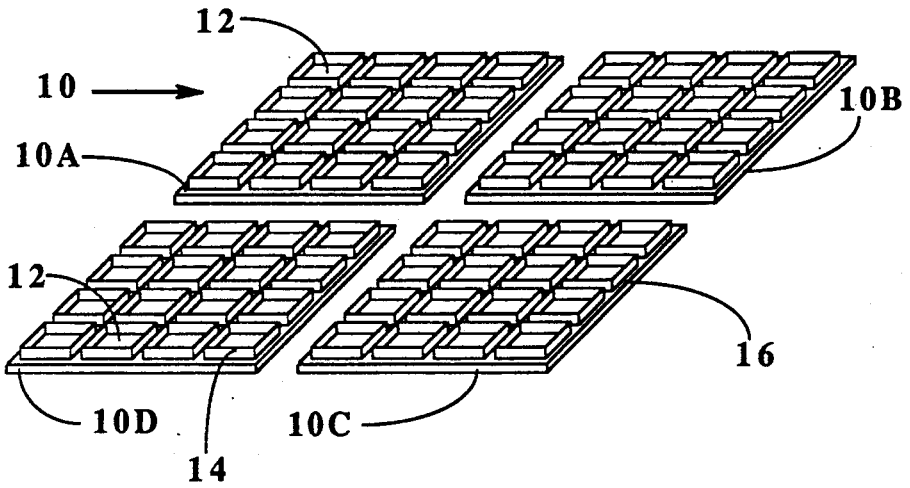
FIG. 1 depicts in schematic perspective four square sections of a gameboard, each section having four gameboard squares on a side making a total of 16 gameboard squares per section, the sections shown ready to be placed together side-by-side as a complete square building surface of the same size as an undivided board totaling 64 gameboard squares, each gameboard square being of an indented male wall configuration adapted to frictionally interlock in a female peripheral wall of a superjacent stacking piece or superjacent top piece.

In FIG. 1, gameboard 10 may be a single entity, or preferably be divided into four separate sections 10A, 10B, 10C, 10D and placed together side by side against each other to form a whole or complete square gameboard 10. Gameboard 10 or gameboard sections 10*a*, 10*b*, 10*c*, 10*d* comprise a plurality of gameboard squares 12 each of which has within its bounds an indented square four-sided male wall 14 having a base or floor 16 extending to the bounds of the gameboard squares 12.

Figure 2:
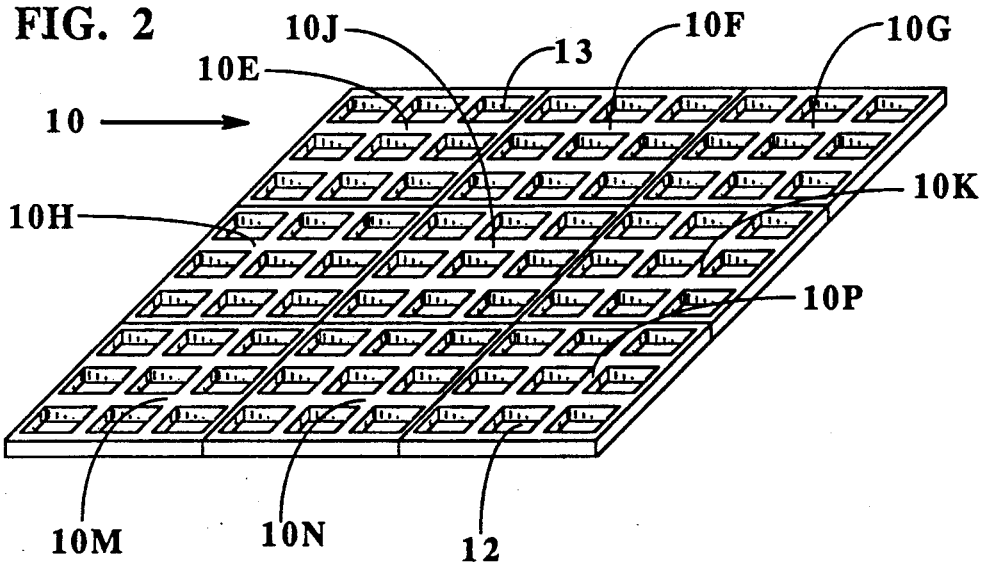
FIG. 2 is a perspective view showing how, if one desires to play oriental chess or "Shogi", an 81-square gameboard according to the invention may be divided into nine square sections, each having three squares on a side for a total of nine squares, each square here shown being of the female wall configuration adapted to frictionally interlock around an indented male wall of a superjacent stacking piece or superjacent top piece.

In FIG. 2 gameboard 10 is shown divided into nine square sections 10E, 10F, 10G, 10H, 10J, 10K, 10M, 10N, 10P each having three gameboard squares 12 along each of its four sides, gameboard squares 12 comprising female peripheral walls 13 collectively forming a grate, a grill, or a grid with cross-bars.

Figure 3:
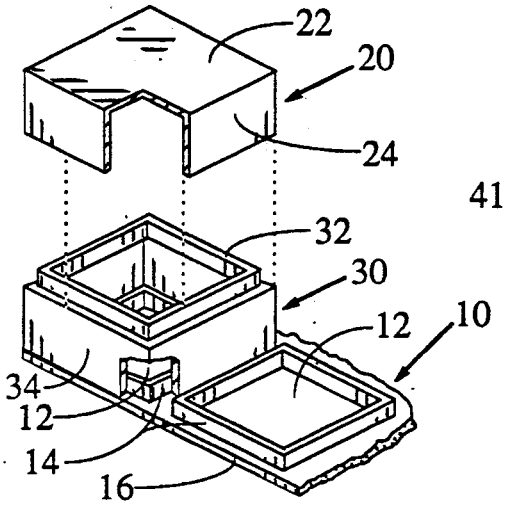
FIG. 3 is a perspective view of a portion of the gameboard or of a gameboard section with two of the gameboard squares having an indented male wall configuration showing a stacking piece stacked on one of the two gameboard squares and a top piece positioned to be stacked upon the stacking piece so as to provide a flat level top playing surface for the respective gameboard square.

In FIG. 3 is depicted a portion of gameboard 10 with two gameboard squares 12 having within their bounds a square four-sided male wall 14 indented horizontally from the bounds or limits of gameboard squares 12 and have a base or floor 16 thereunder extending to the bounds of the gameboard squares 12. One end of stacking piece 30 comprises an indented male wall 32 that corresponds to the indented male walls 14 of gameboard 10 and the other end of stacking piece 30 comprises a female perimeter or peripheral wall 34 which frictionally interlocks over and around an indented male wall 14 of gameboard 10 and may also frictionally interlock over and around an indented male wall 32 of another identical stacking piece 30. The exterior sides or perimeter of peripheral female wall 34 of stacking piece 30 corresponds with the bounds or limits of gameboard squares 12 of gameboard 10. Top piece 20 has an unbroken flat or level upper surface 22 and a female perimeter or peripheral wall 24 which frictionally interlocks over an indented male wall 32 of a stacking piece 30 and may also frictionally interlock over an indented male wall 14 of gameboard 10. The exterior sides or perimeter of female peripheral wall 24 of top piece 20 corresponds with the bounds or limits of gameboard squares 12 of gameboard 10.

Figure 4:
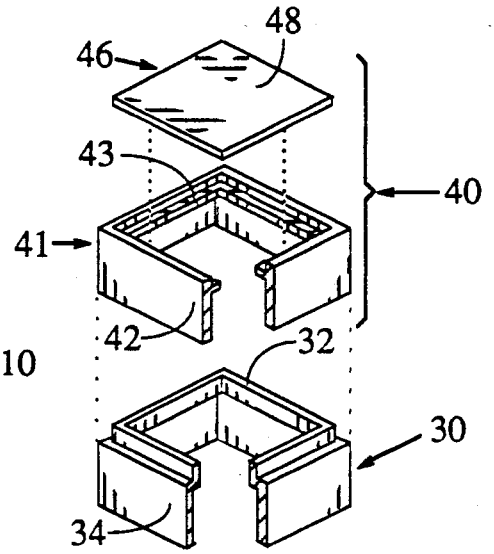
FIG. 4 is a perspective view showing how the parts of a two-part top piece having a square insert part fit together and may then be stacked upon a subjacent stacking piece.

In FIG. 4 top piece 40 is similar to top piece 20 of FIG. 3 except that it is made up of two parts 41 and 46. Part 41 of top piece 40 has a female perimeter or peripheral wall 42 which frictionally interlocks over an indented male wall 32 of a stacking piece 30 and may also frictionally interlock over an indented male wall 14 of gameboard 10. The exterior sides or perimeter of female peripheral wall 42 corresponds with the bounds or limits of gameboard squares 12. A ledge 43 runs around the interior perimeter of female peripheral wall 42 and supports part 46 when placed therein and thereon. Part 46 of top piece 40 is a flat square piece having a continuous flat surface 48 and a perimeter corresponding to the interior perimeter of female peripheral wall 42 of part 41 and frictionally interlocks within female peripheral wall 42 and upon ledge 43 of part 41 so as to yield an overall flat top playing surface for gameboard square 12.

Figure 5:
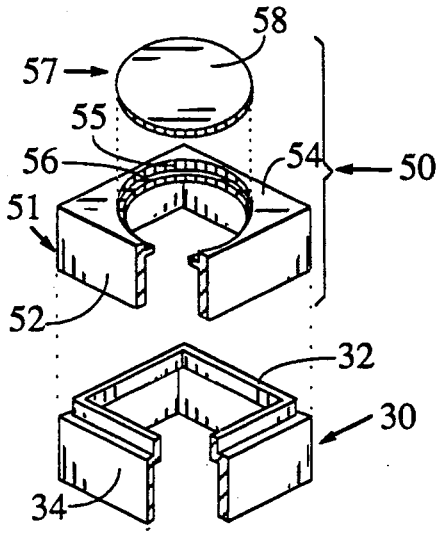
FIG. 5 is a perspective view showing how the parts of a two-part top piece having a circular insert part fit together and may then be stacked on a subjacent stacking piece.

In FIG. 5 top piece 50 is also similar to top piece 20 of FIG. 3 except that it is made up of two parts 51 and 57. Part 51 of top piece 50 has a female perimeter or peripheral wall 52 which frictionally interlocks over an indented male wall 32 of a stacking piece 30 and may also frictionally interlock over an indented male wall 14 of gameboard 10. The exterior sides of female peripheral wall 52 correspond with the bounds of gameboard squares 12. Part 51 of top piece 50 also has an upper surface 54 which has a circular hole 55 centered therewithin, the circular hole 55 having around its perimeter a supporting ledge 56 recessed from surface 54.

Part 57 of top piece 50 is a flat circular piece having a continuous flat surface 58 and a perimeter corresponding to the perimeter of circular hole 55 of part 51 and frictionally fits within circular hole 55 and upon ledge 56 of part 51 so as to yield an overall flat top playing surface for a gameboard square 12.

Figure 6:
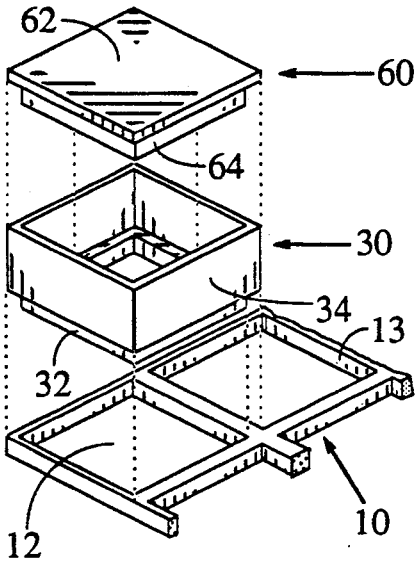
FIG. 6 depicts in perspective view how a top piece having an opposing indented male wall may be frictionally interlocked with a peripheral female wall of a subjacent stacking piece and how an indented male wall of a stacking piece may be frictionally interlocked with a female peripheral wall of a gameboard square of a section of a gameboard or of a complete gameboard, the horizontal outer bounds or limits of the stacking pieces and top pieces being the same as the bounds of the squares of the gameboard, that is, the same bounds as of the four sides of the gameboard squares.

In FIG. 6 two gameboard squares 12 are shown on a portion of gameboard 10. Each gameboard square 12 comprises a peripheral female wall 13. Thus, the collective female peripheral walls 13 cause gameboard 10 to here resemble a grate, a grill or a grid with cross-bars. Indented male wall 32 of stacking piece 30 frictionally interlocks into a complementing peripheral female wall 13 of a gameboard square 12 of gameboard 10. The exterior sides of peripheral female wall 34 of stacking piece 30 correspond with the bounds of gameboard squares 12. Top piece 60 has on one side a continuous flat or level upper surface 62, the perimeter of which corresponds to the exterior sides of peripheral female wall 34 of stacking piece 30 and also to the bounds of gameboard squares 12. The opposing underside of top piece 60 comprises an indented male wall 64 that corresponds to the indented male wall 32 of stacking piece 30. Indented male wall 64 of top piece 60 frictionally interlocks into peripheral female wall 34 of stacking piece 30 and may also frictionally interlock into peripheral female walls 13 of gameboard squares 12 of gameboard 10. Indented male wall 64 of top piece 60 may frictionally interlock into peripheral female wall 42 of part 41 of top piece 40 and rest upon ledge 43 of part 41 of top piece 40.

Figure 7:
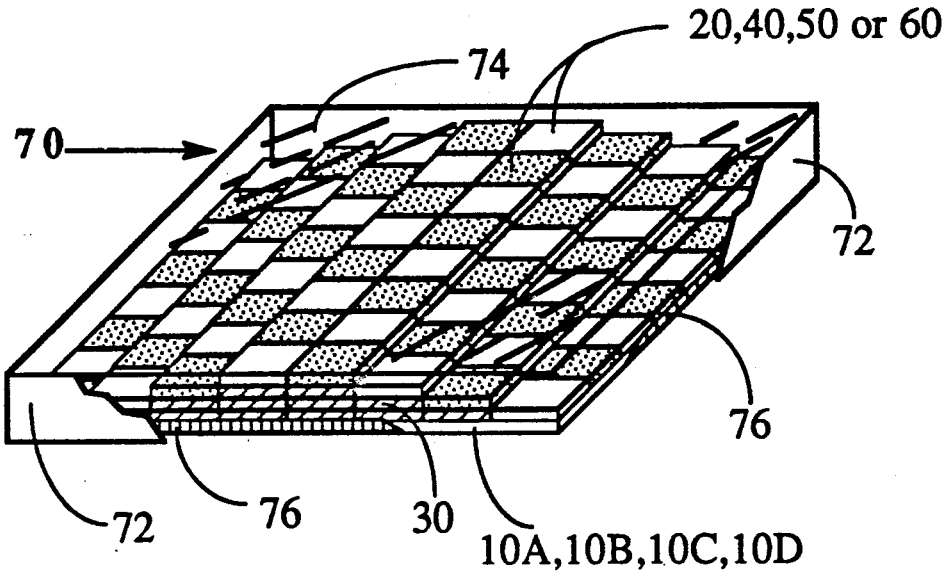
FIG. 7 is a perspective view of a plurality of stacking pieces and a plurality of top pieces assembled upon a gameboard placed within a tray and wrapped in a box or package having a clear cover.

FIG. 7 shows an illustrative packaged assembly kit 70 consisting of a box 72 having a transparent cover 74 and containing therein a gameboard 10 or gameboard sections 10A, 10B, 10C, 10D upon which are assembled stacking pieces 30 and top pieces, such as top pieces 20, 40, 50 or 60, placed within a tray 76.

Figure 8:
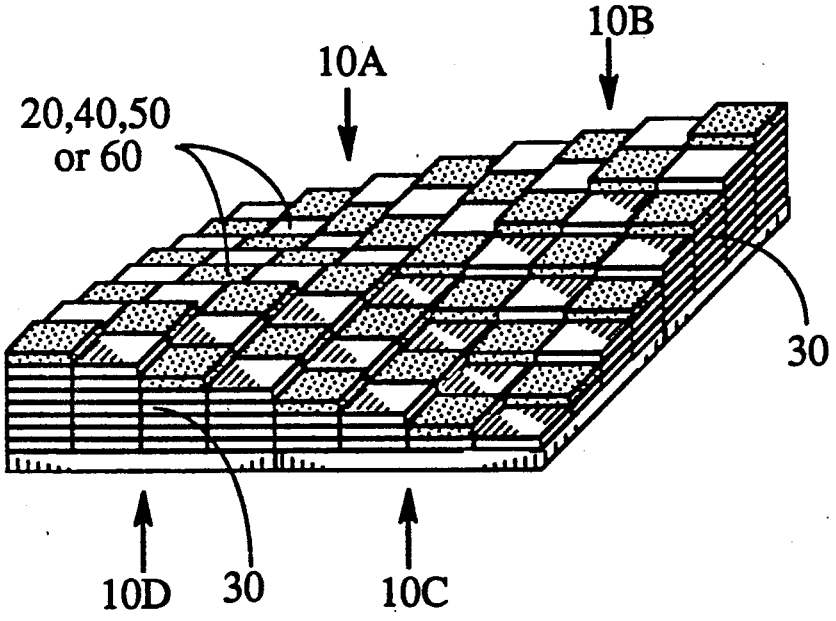
FIG. 8 is a perspective view of a representative topography which may be formed by assembling stacking pieces and top pieces stacked upon the squares of a gameboard according to the invention.

FIG. 8 illustrates a representative topography or pattern which may be created by assembling stacking pieces 30 and top pieces 20, 40, 50, or 60 upon a gameboard 10 or gameboard sections 10*a*, 10*b*, 10*c*, 10*d* placed side by side.

Whatever topography or pattern is created by using the gameboard apparatus of the invention, when the gameboard is made up of sections the gameboard sections may be easily rearranged and reoriented so as to quickly form an entirely different topography. For further variety, stacking pieces may be added, reduced, redistributed or rearranged and top pieces may subsequently be rearranged and reoriented upon the gameboard sections to form still other topographies.

All of the gameboard apparatus of the invention may be manufactured of substantially rigid plastic in a variety of colors and surface textures or finishes using standard plastic molding processes.

While the invention has been described in terms of preferred embodiments, the claims appended hereto are intended to encompass all embodiments which fall within the sprit of the invention.

Having thus described my invention and certain preferred embodiments thereof, I claim:

1. Gameboard apparatus which comprises a square gameboard, said gameboard comprising a plurality of equal playing-position squares, each of said squares comprising a plurality of substantially vertical walls within bounds of said squares, said walls being fixed, adapted to receive and frictionally interlock with substantially vertical walls of superjacent stacking pieces and of superjacent top pieces, a plurality of square stacking pieces, each of said stacking pieces comprising four substantially vertical female peripheral walls, exterior surfaces of which correspond to said bounds of said playing-position squares and a plurality of opposing substantially vertical male walls horizontally indented from said exterior surfaces of said female peripheral walls, and a plurality of top pieces each of said top pieces comprising a top surface, each top surface defined by a substantially flat surface extending throughout said top surface, wherein the exterior surfaces of said female peripheral walls define the bounds of said substantially flat surface and a plurality of opposing substantially vertical walls frictionally interlockable with said walls of said gameboard and with said walls of said stacking pieces.

2. The gameboard apparatus of claim 1 wherein each of said gameboard playing-position squares comprise a plurality of male walls horizontally indented from said bounds of each of said playing-position squares.

3. The gameboard apparatus of claim 1 wherein each of said gameboard playing-position squares comprise a plurality of female walls, outer perimeters of which correspond substantially to said bounds of said playing-position squares.

4. The gameboard apparatus of claim 1 wherein said square gameboard comprises a plurality of equal square sections adapted to be placed flushly side-by-side against each other to form said square gameboard as a unit.

5. The gameboard apparatus of claim 1 wherein said gameboard comprises four equal square sections, each of said sections comprising sixteen of said equal playing-position squares arranged in an equilateral four-by-four matrix.

6. The gameboard apparatus of claim 1 wherein said gameboard comprises nine equal square sections, each of said sections comprising nine of said equal playing-position squares arranged in an equilateral three-by-three matrix.

7. The gameboard apparatus of claim 1 wherein said top pieces comprise two parts, one comprising a vertical female peripheral wall having an inside ledge and the other part comprising a flat part adapted to fit within said peripheral wall and onto said inside ledge.

8. Gameboard apparatus which comprises in constructive combination:

(1) a square gameboard, said square gameboard comprising a plurality of equal square sections, said sections comprising a plurality of playingposition squares and each of said squares comprising a plurality of substantially vertical walls within bounds of said squares, (2) a plurality of square stacking pieces each comprising four substantially vertical female peripheral walls, exterior surfaces of which correspond to said bounds of said playing-position squares and a plurality of opposing substantially vertical male walls horizontally indented from said exterior surfaces of said female peripheral walls, and (3) a plurality of square top pieces each of said top pieces having a top surface, each top surface defined by a substantially flat surface extending throughout said top surface, wherein the exterior surfaces of said female peripheral walls define the bounds of said substantially flat surface and a plurality of opposing substantially vertical walls frictionally interlockable with said walls of said gameboard and with said walls of said stacking pieces, said substantially vertical walls within said playing-position squares being frictionally interlockable with said substantially vertical walls of said stacking pieces and with said opposing substantially vertical walls of said top pieces, and said substantially vertical walls of said stacking pieces being frictionally interlockable with said opposing substantially vertical walls of said top pieces, with said substantially vertical walls within bounds of said playing-position squares and with said substantially vertical walls of other identical stacking pieces.

9. The gameboard apparatus of claim 8 wherein said gameboard sections, stacking pieces and top pieces are made of plastic and are packaged.

10. The gameboard apparatus of claim 8 wherein said plurality of equal square sections are placed together to form said square gameboard and said stacking pieces and said top pieces are assembled upon said gameboard.

11. The gameboard apparatus of claim 8 packaged in a tray, said tray containing said gameboard with said stacking pieces and said top pieces stacked on said gameboard, said gameboard sections being placed together in said tray to form said gameboard.

12. The gameboard apparatus of claim 8 wherein said substantially vertical walls within bounds of said playing-position squares comprise female walls, outer perimeters of which correspond substantially to said bounds of said playing-position squares.

13. The gameboard apparatus of claim 8 wherein said substantially vertical walls within bounds of said playing-position squares comprise male walls indented horizontally from said bounds of said playing-position squares.

14. The gameboard apparatus of claim 8 wherein said square top pieces comprise two parts, one comprising a vertical female peripheral wall with an inside ledge and the other comprising a flat part adapted to fit on said ledge.

15. The gameboard apparatus of claim 8 wherein said sections are placed together to form said square gameboard, said gameboard is placed within a square tray, said stacking pieces and said top pieces are stacked upon said gameboard and said tray containing said gameboard with stacking pieces and top pieces stacked thereupon is packaged.

16. A gameboard apparatus kit which comprises as working components thereof adapted to frictionally interlock to form a multistepped game-playing topography:

(1) a square tray having four side walls, (2) a square gameboard comprising a plurality of equal square sections, each of said sections comprising a plurality of playing-position squares and being placed together in said tray to form said square gameboard and each of said squares comprising a plurality of substantially vertical walls within bounds of the square, said gameboard fitting snugly within said four side walls, (3) a plurality of stacking pieces each comprising four substantially vertical female peripheral walls, exterior surfaces of which correspond to said bounds of said playing-position squares and a plurality of opposing substantially vertical male walls horizontally indented from said exterior surfaces of said female peripheral walls, and (4) a plurality of top pieces, each of said top pieces having a top surface, each top surface defined by a substantially flat surface extending throughout said top surface, wherein the exterior surfaces of said female peripheral walls define the bounds of said top surface and opposing said top surface a plurality of substantially vertical walls frictionally interlockable with said walls of said gameboard and with said walls of said stacking pieces, some of said top pieces being stacked on some of said squares, a remainder of said top pieces being stacked on some of said stacking pieces, some of said stacking pieces being stacked upon one another and a remainder of said stacking pieces being stacked upon a remainder of said squares, and said tray with stacking pieces and top pieces placed therein stacked upon said gameboard is packaged.

17. The gameboard apparatus kit of claim 16 wherein said substantially vertical walls within said bounds of each of said playing-position squares comprise male walls horizontally indented from said bounds of said playing-position squares.

18. The gameboard apparatus kit of claim 16 wherein said substantially vertical walls within said bounds of each of said playing-position squares comprise female walls, outer perimeters of which correspond substantially to said bounds of said playing-position squares.

19. The gameboard apparatus kit of claim 16 wherein said top pieces comprise two parts, one comprising a vertical female peripheral wall having an inside ledge and the other part comprising a flat part adapted to fit on said inside ledge and to complete said top level surface.

* * * * *